United States Patent [19]

Neff

[11] 4,365,379

[45] Dec. 28, 1982

[54] PIPELINE PIG HAVING IMPROVED END PLATE RETENTION

[75] Inventor: Larry M. Neff, Tulsa, Okla.

[73] Assignee: S.U.N. Engineering, Inc., Tulsa, Okla.

[21] Appl. No.: 253,890

[22] Filed: Apr. 13, 1981

[51] Int. Cl.[3] ..... B08B 9/04

[52] U.S. Cl. ..... 15/104.06 R

[58] Field of Search ..... 15/104.06 R, 104.06 A; 137/268

[56] References Cited

U.S. PATENT DOCUMENTS 2,392,144 1/1946 Hall ..... 15/104.06 R 4,083,074 4/1978 Curtis ..... 15/104.06 R

FOREIGN PATENT DOCUMENTS 452374 4/1975 U.S.S.R. ..... 15/104.06 R

*Primary Examiner*—Edward L. Roberts

*Attorney, Agent, or Firm*—Head, Johnson & Stevenson

[57] ABSTRACT

A pipeline pig made of plastic parts in which the parts are assembled on a tubular shaft, the end plate which holds the assembled parts on the shaft fitting over an enlarged diameter portion on the shaft, the shaft being inwardly deflectable to permit the end plate to pass over the enlarged diameter portion by the provision of slots in the shaft end, and a hub fitted within the shaft to prevent deflection of the shaft after the end plate is in position.

6 Claims, 6 Drawing Figures

PIPELINE PIG HAVING IMPROVED END PLATE RETENTION

BACKGROUND OF THE INVENTION

1. Field of the Invention

This invention relates to pipeline pigs of the type formed about a central shaft of flexible plastic material plastic and is particularly directed to an improved means of supporting a flange on the rearward end of the shaft.

For information relating to the use of pipeline pigs, reference may be had to the application 90,628, now Patent 4,275,475.

2. Description of the Prior Art

The use of pipeline pigs, and their construction, has long been known in the petroleum industry. Generally speaking, a pipeline pig is an apparatus which is inserted into a pipeline and travels through the line, usually by the movement of liquids or gases in the line, to accomplish purposes such as cleaning the interior of the line, removing paraffin, separating one type of fluid from another, removing entrapped water, inspecting the pipeline and so forth. The present invention is directed toward a type of pipeline pig which is formed primarily of plastic. Various cup-shaped devices may be employed on a pipeline pig for accomplishing the various services desired; and in the arrangement of the present invention, the working elements are assembled on an elongated cylindrical shaft. After the elements are assembled on the shaft, means must be provided for retaining them on the shaft and this is the objective of the present invention. While others have provided various devices for assembling the working elements of a pipeline pig onto a shaft, the present invention is unique in the provision of means employing a minimum of parts and yet retaining maximum strength of the assembled pipeline pig.

SUMMARY OF THE INVENTION

The invention is directed towards a pipeline pig having operating members, such as a cups or dish members dimensioned to engage the interior wall of the pipeline, and provides an improved means for retaining the operating member on a shaft. The shaft is formed of flexible plastic material and is adapted to receive the operating member thereon. The shaft is tubular, or at least the rearward end portion of the shaft is tubular, and is provided with an integral enlarged diameter portion adjacent the shaft rearward end. Formed in the end of the shaft are a plurality of spaced apart longitudinal slots, the slots being in planes of the shaft axis with the slots extending forwardly past the enlarged diameter portion. An end plate is utilized having an opening therethrough, the diameter of the opening being slightly larger than the diameter of the shaft and smaller than the shaft enlarged diameter portion. The end plate can be inserted onto the shaft rearward end past the enlarged diameter portion by deflecting the portions between the slots inwardly. After the end plate is inserted onto the end of the shaft past the enlarged diameter portion, the portions between the slots return to the normal shaft diameter. A plug member is positioned in the shaft rearward end serving to prevent the inward deflection of the portions of the shaft between the slot. In the preferred arrangement the plug member has raised boss portions which are received in the slots formed in the shaft and conform to the normal exterior configuration of the shaft at the enlarged diameter portion. A means is provided to retain the plug member in position, such as a metal clamp around the rearward end of the shaft. With the end plate, plug member, and retention means in position, cups, dish members or other working elements assembled onto the shaft are retained securely on the shaft and are held in proper position as the pipeline pig travels through the length of a pipeline.

DESCRIPTION OF THE PREFERRED EMBODIMENT

Figure 1:
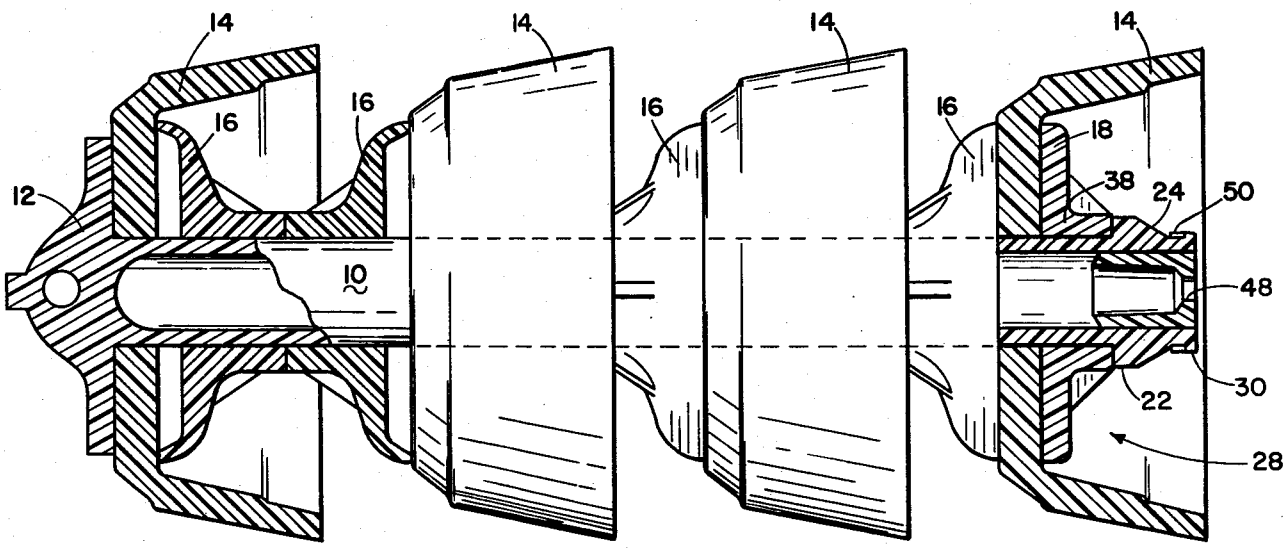
FIG. 1 is an elevational view of a pipeline pig shown partially in cross-section and showing, at the rearward end thereof, the improved end plate retention of this system.

Referring to the drawings and first to FIG. 1, a type of pipeline pig which successfully employs the principle of the invention is illustrated, it being understood that the particular arrangement of the pipeline pig is not the crux of the invention but instead, the invention is directed to a means of retaining the end plate of an assembled pipeline pig in position. The pig includes a central shaft 10 which is preferably cylindrical and is also preferably formed of a flexible material such as plastic. The shaft 10 includes a head portion 12 at the forward end to retain working members on the shaft. The working members illustrated in FIG. 1 are in the form of disc-shaped members 14 which have an external diameter configured to engage the interior of the pipeline in which the pig is used. It is understood that the particular configuration of the disc-shaped member 14 may vary considerably and is not a part of the present invention. Spacers 16 are utilized to separate the disc-shaped members 14. However, the particular configuration of spacers 16 also are not part of the invention.

The invention is directed towards a means of retaining working elements exemplified by the members 14 and spacers 16 on shaft 10, and more particularly, means for retaining the end plate 18 on the shaft. For more details of how this is accomplished, reference may be had to FIGS. 2 through 6.

Figure 2:
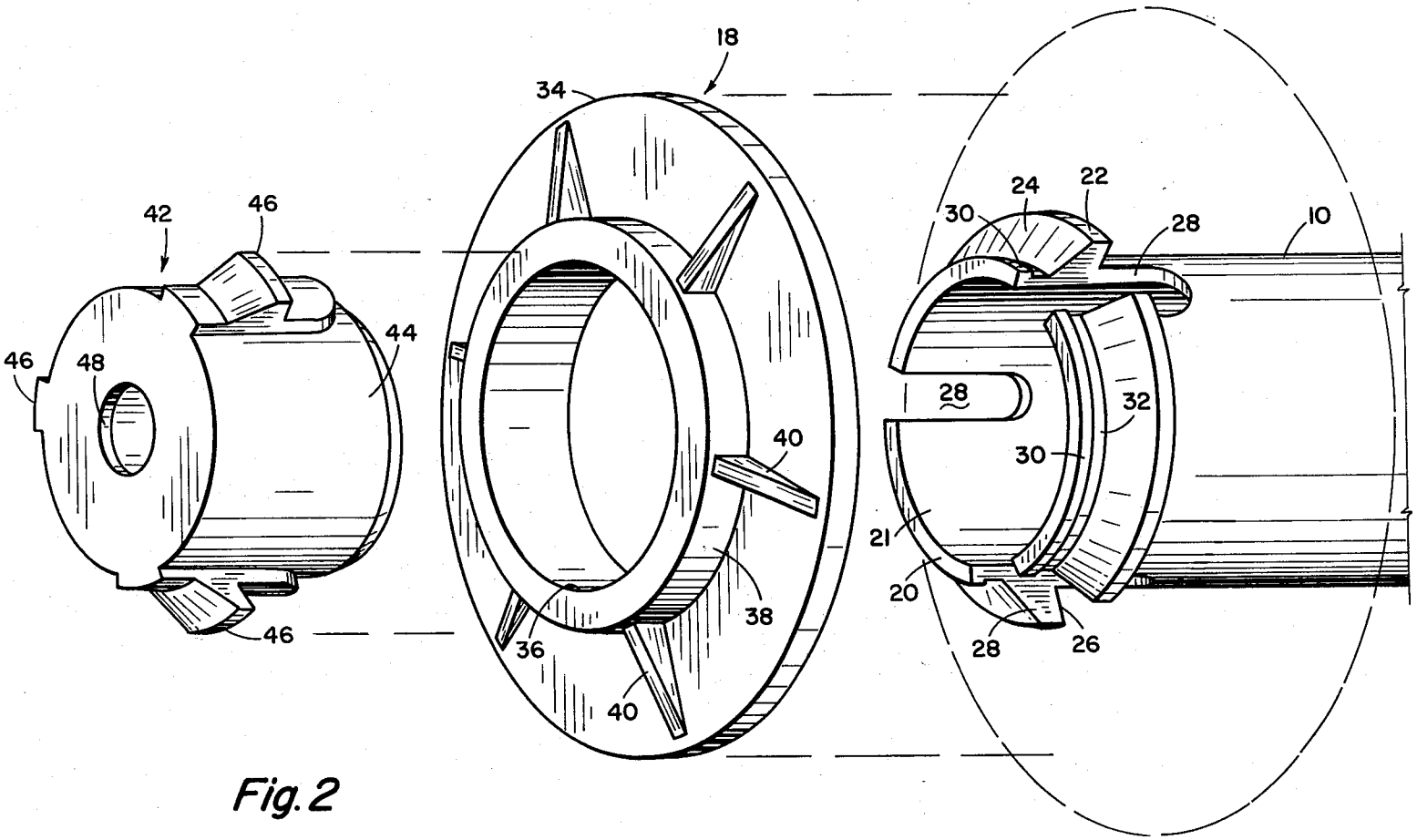
FIG. 2 is an exploded view of the elements employed in the improved end plate retention system.
Figure 6:
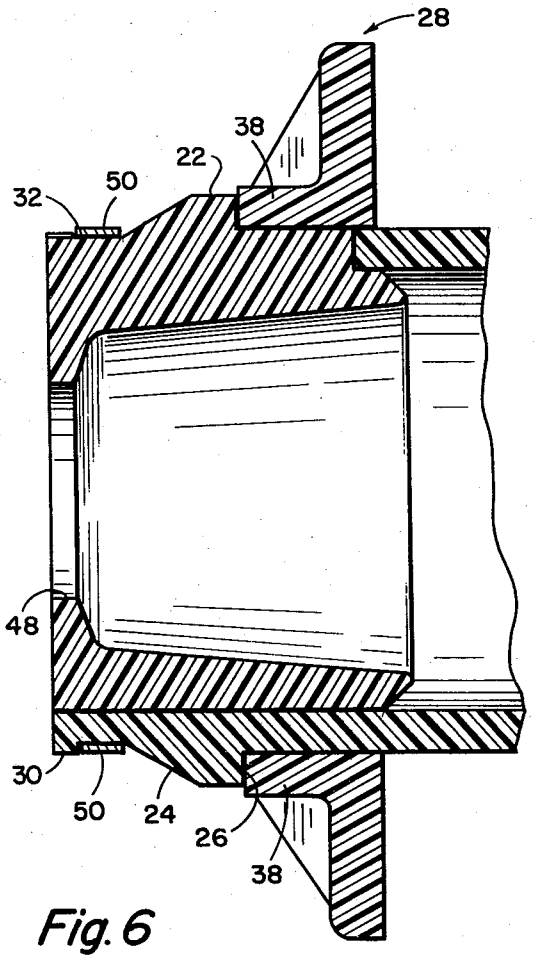
FIG. 6 is a cross-sectional view taken along the line 6—6 of FIG. 5 of the fully assembled retention means.

Referring first to FIG. 2, an exploded view is shown which reveals the details of each of the most important elements of the invention. The shaft 10 has a rearward end 20. Spaced from the rearward end is an enlarged external diameter portion 22 which is integral with the shaft. The enlarged diameter portion has, in cross-sectional configuration, as seen in FIG. 6, a sloped rearward surface 24 and a forward surface 26 which is in a plane perpendicular the longitudinal axis of the shaft.

Shaft 10 is preferably tubular or at least the portion adjacent the rearward end 20 is tubular. Formed in the shaft are a plurality of spaced apart slots 28, there being three shown in the drawings. The slots 28 extend from the rearward end 20 past the enlarged diameter portion 22. The purpose of the slots 28 is to permit inward deflection of the areas of shaft 10 between the slots for purposes which will be described subsequently.

Rearwardly of the enlarged diameter portion 22 is a second enlarged diameter portion 30 which is spaced from the first mentioned enlarged diameter portion 22. Between the portions 22 and 30 is formed a valley 32 which is of the normal diameter of shaft 10.

FIG. 2 is shows, rearwardly of the shaft end, the plate 18 which preferably has a cylindrical external surface 34, although it can be seen that the specific configuration of the external surface is not critical. Formed in shaft 18 is an axial central opening 36 of internal diameter slightly greater than the normal external diameter of shaft 10 and smaller than the external diameter of the shaft enlarged diameter portion 22. In the illustrated arrangement the end plate 18 has an integral increased length portion 38 with integrally formed reinforcing flanges 40 radiating outwardly therefrom to provide stiffness to the plate. The specific configuration of plate 18 is not critical—the entire plate may be of thickness equal to the increased length portion 38 if desired. Plate 18 may be formed of plastic or metal.

The third important element in the invention, as shown in FIG. 2, is the plug member generally indicated by the numeral 42. This member is of short cylindrical configuration, the normal external cylindrical surface 44 being of a diameter to be slidably received within the interior of the rearward end of shaft 10; that is, the external diameter of the plug cylindrical surface 44 is slightly less than the internal diameter of the tubular interior 21 of the shaft 10. Integrally formed on the exterior of plug 42 are a plurality of raised bosses, the number corresponding to the number of slots 28 formed in shaft 10. The configuration of the integral boss portions 46 is such that when the lug is inserted into the end of shaft 10 as shown in FIGS. 4, 5 and 6, the boss portions 46 conform in shape and dimension to the shaft and the integral raised portion 22 on the shaft.

Plug member 42 may be solid or, as illustrated, may be hollow with an axial opening 48 in the end. The function of opening 48 is to allow fluid or gas pressure within a pipeline to equalize with that interiorly of the shaft 10 so that there is no tendency of the pipeline pressure to collapse the shaft.

Figure 3:
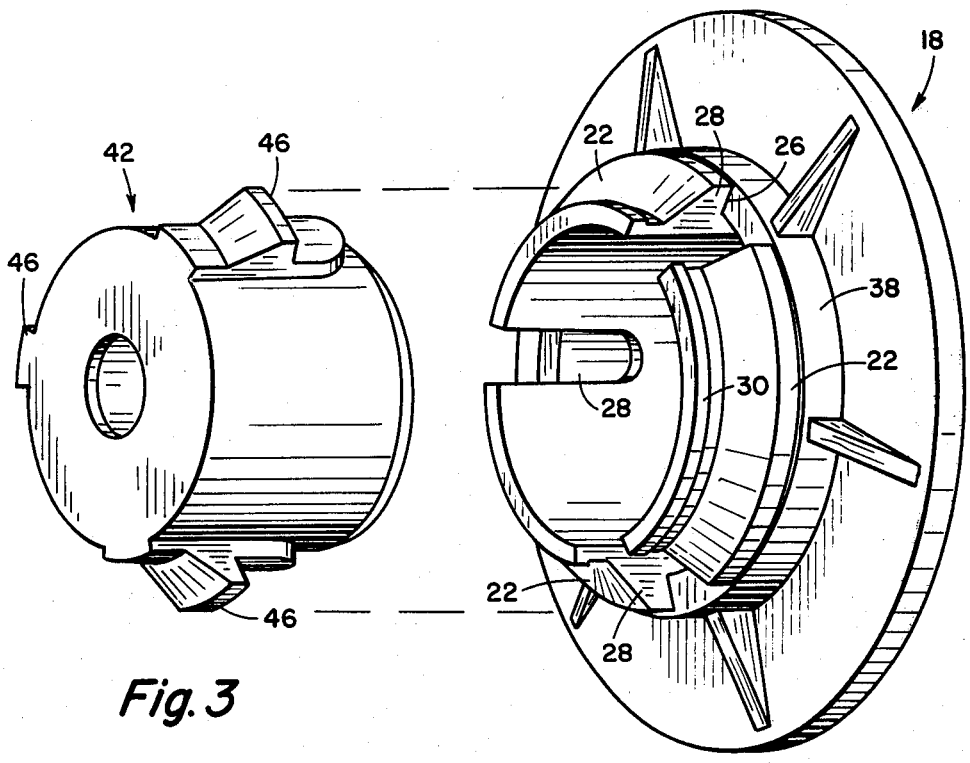
FIG. 3 is an isometric view showing the end plate in position on the end of the shaft preparatory to the insertion of the plug member.
Figure 4:
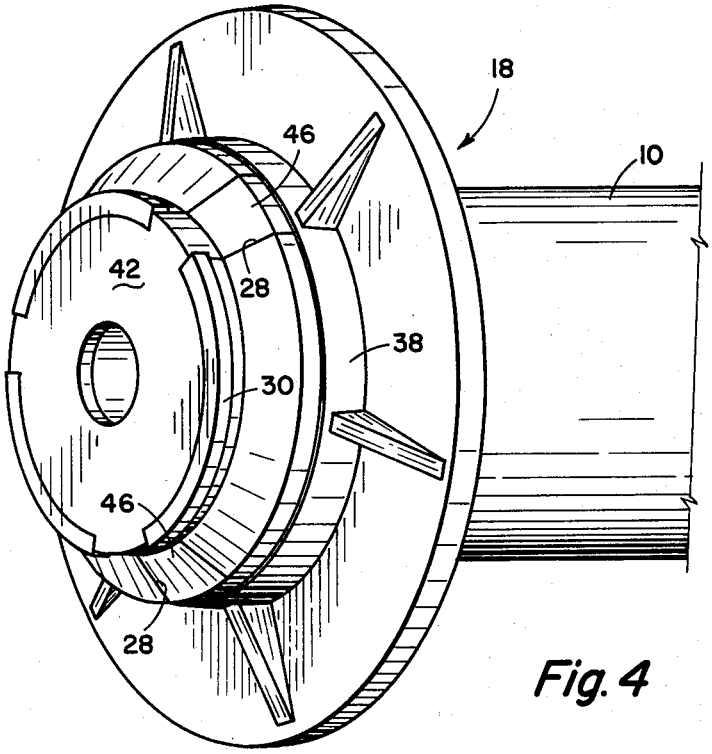
FIG. 4 is an isometric view of the plate and plug member in position in the end of the shaft.
Figure 5:
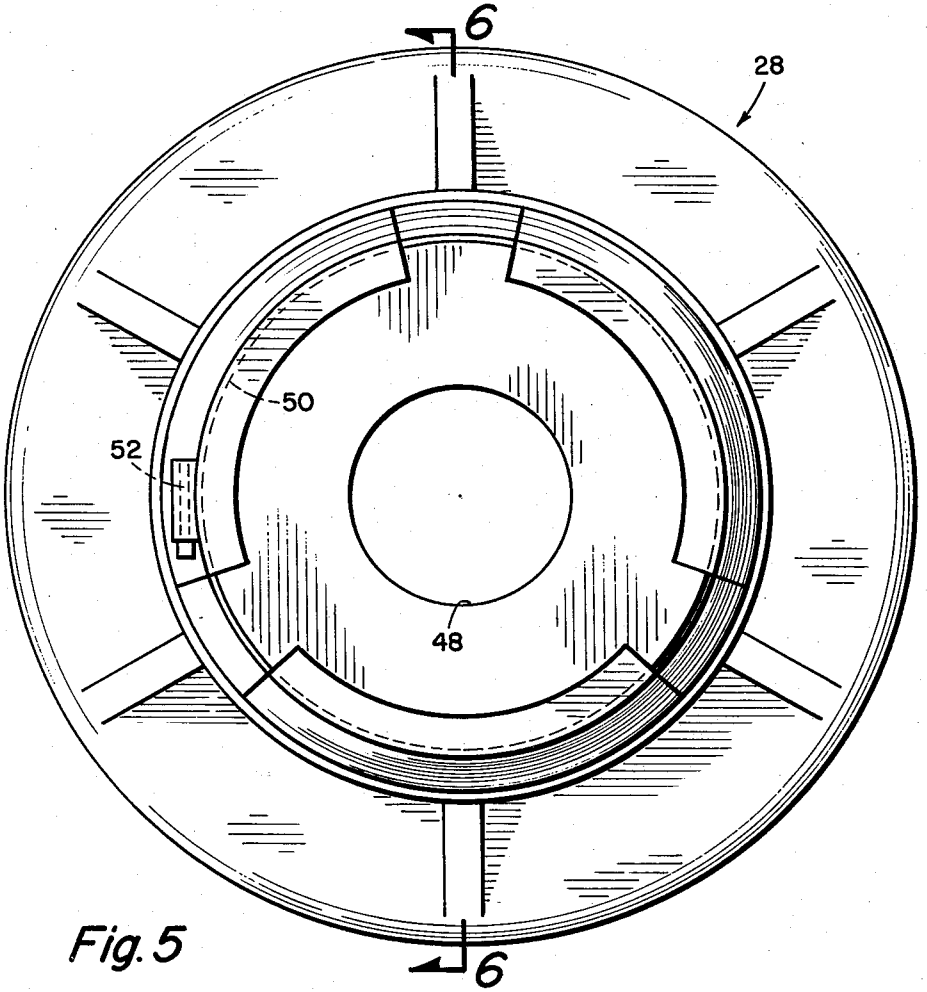
FIG. 5 is an end view of the assembled plate retention means.

Referring to FIGS. 3 and 4, the method of assembly of the device is shown. After disc members 14 and spacer 16, or similar working elements, are inserted onto the shaft, the plate 18 is next positioned on the shaft rearward end. This is accomplished by forcing the plate 18 over the shaft integral enlarged diameter portions 22. By provision of slots 28, the area of the shaft between the slots may be inwardly deflected so that the plate will pass over the enlarged diameter portion to assume the position as shown in FIG. 3. After the plate passes over the enlarged diameter portion 22 the area of the shaft between the slots, by natural resiliency, returns to the normal configuration as shown in FIG. 2. Thus, the end plate 18 is held in position on the shaft by engagement with the radial surface 26 of the enlarged diameter portion 22.

To ensure retention of end plate 18 in the position by preventing subsequent inward deflection of the area between slots 28, plug member 42 is inserted into position in the end of the shaft as shown in FIG. 4. The boss portions 46 of the plug enter notches 28 so that a uniform exterior configuration of the assembled elements is provided as shown in FIG. 4.

The assembled apparatus is illustrated in FIGS. 5 and 6, without showing any cup or disc member or other elements which would be assembled on the shaft. To retain the plug member in position a metal band 50 is positioned around the assembled shaft rearward end and around the plug in the valley 32 between the shaft integral enlarged diameter portion 22 and the integral enlarged diameter end portion 30. The metal band 50 may be of the typical water hose type including a screw thread tightening means 52. With the band securely tightened on the end of the shaft, the assembled plug is prevented from being displaced from the interior of the shaft and the plug prevents the inward deflection of the shaft between notches 28. Thus, the end plate is securely held in position and is prevented from being inadvertently dislodged.

All of the basic components making up the pipeline pig improved end plate retention system as described herein may be formed of moldable material such as plastic. The arrangement allows for expeditious assembly of the end plate and, most importantly, ensures secure retention of the end plate on the shaft.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. In a pipeline pig having at least one operating member dimensioned to engage the interior wall of a pipeline, an improved end retainer means comprising:

a cylindrical shaft of flexible plastic material adaptable to receive at least one operating member thereon, at least the rearward end portion being tubular and having an integral enlarged diameter portion adjacent the rearward end, and having a plurality of spaced-apart longitudinal slots formed in the rearward end, the slots being in planes of the shaft axes and extending forwardly past the enlarged diameter portion;

an end plate having an opening therethrough the diameter of which is slightly larger than the diameter of said shaft and smaller than said shaft enlarged diameter portion, the end plate being insertable onto said shaft rearward end past said enlarged diameter portion by deflecting the portions of the shaft rearward end between said slots inwardly;

a plug member positioned in said tubular shaft rearward end serving to prevent the inward deflection of the portions of the shaft rearward end between said slots; and means to retain said plug member in position within said tubular shaft end.

2. An improved end retainer means for a pipeline pig according to claim 1 wherein said plug member has enlarged diameter integral boss portions in spaced apart relationship, each boss portion lying in a plane of the plug member longitudinal axis and being of width of said slots and in registery with said slots.

3. An improved end retainer means for a pipeline pig according to claim 2 in which the configuration of said plug member boss portions conforms to the external configuration of the shaft enlarged diameter portions.

4. An improved end retainer means for a pipeline pig according to claim 2 in which said means to retain said plug in position within said tubular shaft end includes a metal band secured around said shaft rearwardly of said enlarged diameter portions.

5. An improved end retainer for a pipeline pig according to claim 4 wherein said shaft rearward end has an enlarged diameter integral flange portion rearwardly of said enlarged diameter portion, said metal band being received between said enlarged diameter portion and said flange portion.

6. An improved end retainer for a pipeline pig according to claim 1 wherein said shaft integral enlarged diameter portion is defined in cross-section taken in the plane of the shaft axes by a sloping surface in the direction of the shaft rearward end.

* * * * *